US005409038A

United States Patent [19]

Yoshida et al.

[11] Patent Number: 5,409,038

[45] Date of Patent: Apr. 25, 1995

[54] HYDRAULIC CIRCUIT INCLUDING PRESSURE COMPENSATING VALVE

[75] Inventors: Nobumi Yoshida; Teruo Akiyama; Tadao Karakama, all of Kanagawa, Japan

[73] Assignee: Kabushiki Kaisha Komatsu Seisakusho, Tokyo, Japan

[21] Appl. No.: 944,234

[22] Filed: Sep. 14, 1992

[30] Foreign Application Priority Data

Jan. 23, 1991 [JP] Japan ..... 3-021448

[51] Int. Cl.[6] ..... F15B 13/02

[52] U.S. Cl. ..... 137/596; 91/446; 137/596.13; 137/596.14

[58] Field of Search ..... 137/596, 596.13, 596.14; 91/446

[56] References Cited

U.S. PATENT DOCUMENTS

| | | | |
|---|---|---|---|
| 3,937,129 | 2/1976 | Miller | 137/596.13 X |
| 4,967,557 | 11/1990 | Izumi et al. | 91/446 X |
| 5,056,312 | 10/1991 | Hirata et al. | 91/518 X |
| 5,062,350 | 11/1991 | Tanaka et al. | 91/446 X |
| 5,083,430 | 1/1992 | Hirata et al. | 137/596.14 X |
| 5,134,853 | 8/1992 | Hirata et al. | 91/518 X |
| 5,146,747 | 9/1992 | Sugiyama et al. | 91/446 X |
| 5,150,574 | 9/1992 | Hirata et al. | 91/446 X |
| 5,152,143 | 10/1992 | Kajita et al. | 91/518 X |

FOREIGN PATENT DOCUMENTS

| | | |
|---|---|---|
| 1-266301 | 10/1989 | Japan . |
| 02-89803 | 3/1990 | Japan . |

*Primary Examiner*—Gerald A. Michalsky

*Attorney, Agent, or Firm*—Vorys, Sater, Seymour & Pease

[57] ABSTRACT

A hydraulic circuit including a pressure compensating valve, which aims at preventing the delay in operation of the valve due to the time required for the inflow of fluid in amount corresponding to stroke volume thereof, thereby improving the response of thereof. This hydraulic circuit includes a pressure compensating valve (3) provided between the delivery side of a hydraulic pump (1) and the inlet of a directional control valve (4), the pressure compensating valve (3) being arranged to be urged by the pressure applied to first pressure receiving portion (6) to position (D) where the area of opening thereof is kept maximum, and also urged by the pressure applied to second pressure receiving portion (8) to position (E) where the area of opening thereof is kept minimum, the portions (6) and (8) being connected with the outlet and inlet sides of the valve (4). The circuit includes a hydraulic cylinder (30) adapted to push the valve (3) to the position (D) and whose piston elongating chamber (31) is connected with an exterior pressurized fluid supply (11) and whose piston retracting chamber (34) is connected with the portion (6) so that when the valve (4) is located at neutral position (A) the valve (3) is held at position (D).

6 Claims, 10 Drawing Sheets

HYDRAULIC CIRCUIT INCLUDING PRESSURE COMPENSATING VALVE

TECHNICAL FIELD OF THE INVENTION

This invention relates to a hydraulic circuit including a directional control valve for supplying fluid under pressure discharged by a hydraulic pump into hydraulic actuators, and a pressure compensating valve of the type which is rendered operative in response to the pressure drop of the pressurized fluid flowing through the directional control valve.

BACKGROUND OF THE INVENTION

As the hydraulic circuit of the type including a pressure compensating valve, a circuit as shown in FIG. 1 is heretofore known, for example.

That is to say; a discharge conduit 2 of a hydraulic pump 1 is connected with an inlet of a pressure compensating valve 3 whose outlet is connected with an inlet of a directional control valve 4. The arrangement is made such that when the directional control valve 4 is changed from its neutral position A over either to a first pressurized fluid supply position B or to a second pressurized fluid supply position C the fluid under pressure discharged by the hydraulic pump 1 is supplied into hydraulic actuators 5.

The above-mentioned pressure compensating valve 3 is arranged to be urged by the fluid pressure applied to its first pressure receiving portion 6 in combination with the resilient force of a spring 7 to a position D where the area of opening thereof is kept maximum, and also urged by the fluid pressure applied to its second pressure receiving portion 8 to a position E where the area of the opening thereof is kept minimum. The first pressure receiving portion 6 is connected with a load pressure circuit 9 so that the fluid pressure on the outlet side of the directional control valve 4 is supplied through a load pressure detection circuit 10 formed within the control valve 4 into the first pressure receiving portion 6. Whilst, the second pressure receiving portion 8 is connected with the outlet side of the pressure compensating valve 3 so that the fluid pressure on the inlet side of the directional control valve 4 is supplied into the second pressure receiving portion 8. Thus, the pressure compensating valve 3 is rendered operative in response to the pressure drop of the fluid under pressure flowing through the directional control valve 4.

The above-mentioned directional control valve 4 is arranged to be changed from its neutral position A over either to a first pressurized fluid supply position B or to a second pressurized fluid supply position C when the pressurized fluid discharged by an auxiliary hydraulic pump 11 is supplied through a pilot fluid pressure change-over valve 12 either into a first pressure receiving portion 13 or into a second pressure receiving portion 14. When the directional control valve 4 is located at its neutral position A its pumping port 15 is disconnected and the load pressure circuit 9 is allowed to communicate with a fluid tank 16.

The above-mentioned hydraulic pump 1 is of a variable displacement type, and the angle of swash plate 17 thereof is changed over by the action of a servo-cylinder 18 whose small diameter chamber 19 is supplied directly with the discharge pressure of the hydraulic pump 1 and whose large diameter chamber 20 is supplied with the discharge pressure of the hydraulic pump 1 through a control valve 21. The control valve 21 is rendered operative in response to the pressure differential between the discharge pressure of the hydraulic pump 1 and the load pressure in the above-mentioned load pressure circuit 9. The hydraulic pump 1 is arranged such that the discharge pressure thereof is set to become higher than the load pressure by a value which, for example, corresponds to the resilient force of the spring 22, and even when the directional control valve 4 is located at its neutral position A where the outflow of the fluid under pressure discharged by the hydraulic pump 1 is blocked, the discharge pressure of the hydraulic pump 1 is prevented from becoming excessively high.

In such a hydraulic circuit, when the directional control valve 4 is located at its neutral position A the load pressure circuit 9 is connected through a passage 23 formed within the directional control valve 4 with the fluid tank 16 thus keeping the load pressure at zero so that the pressure compensating valve 3 is held by the action of the discharge pressure of the hydraulic pump 1 at a position E where the area of opening thereof is kept minimum.

For this reason, when the directional control valve 4 is changed from its neutral position over either to the first pressurized fluid supply position B or to the second pressurized fluid supply position C to supply the pressurized fluid on the outlet side of the directional control valve 4 into the load .pressure circuit 9, the fluid pressure in the second pressure receiving portion 8 of the pressure compensating valve 3 will rise after the pressurized fluid has flowed into the second pressure receiving portion 8 by an amount corresponding to the stroke volume thereof, and therefore it takes a time for the pressure rise, which causes a delay in operation of the pressure compensating valve 3, thereby deteriorating the response of the entire hydraulic circuit.

SUMMARY OF THE INVENTION

The present invention has been made in view of the above-mentioned circumstances in the prior art, and has for its object to provide a hydraulic circuit including a pressure compensating valve wherein when a directional control valve is changed from its neutral position over to a pressurized fluid supply position to drive a hydraulic actuator or actuators the response of the pressure compensating valve can be improved without causing any delay in operation of the pressure compensating valve due to the time required for the inflow of fluid in an amount corresponding to the stroke volume thereof so that the response of the hydraulic circuit can be improved.

To achieve the above-mentioned object, according to a first aspect of the present invention, there is provided a hydraulic circuit including a pressure compensating valve wherein the pressure compensating valve is provided between a hydraulic pump and a directional control valve, the pressure compensating valve being arranged to be urged by the fluid pressure applied to its first pressure receiving portion to a position where the area of opening thereof is kept maximum, and also urged by the fluid pressure applied to its second pressure receiving portion to a position where the area of opening thereof is kept minimum, the first pressure receiving portion being connected with the outlet side of the directional control valve, the second pressure receiving portion being connected with the inlet side of the directional control valve, characterized in that it comprises a hydraulic cylinder means having a piston for pushing against the pressure compensating valve to the position where the area of opening thereof is kept maximum, and a piston elongating chamber is connected with an exterior pressurized fluid supply source, whilst a piston retracting chamber is connected with the first pressure receiving portion.

Further, to achieve the above-mentioned object, according to a second aspect of the present invention, there is provided a hydraulic circuit including a pressure compensating valve wherein the pressure compensating valve is provided between a hydraulic pump and a directional control valve, the pressure compensating valve being arranged to be urged by the fluid pressure applied to its first pressure receiving portion to a position where the area of opening thereof is kept maximum, and also urged by the fluid pressure applied to its second pressure receiving portion to a position where the area of opening thereof is kept minimum, the first pressure receiving portion being connected with the outlet side of the directional control valve, the second pressure receiving portion being connected with the inlet side of the directional control valve, characterized in that it comprises a hydraulic cylinder means having a piston for pushing against the pressure compensating valve to the position where the area of opening thereof is kept maximum, and a piston elongating chamber is connected with the outlet side of a pilot fluid pressure change-over valve adapted to change over the directional control valve.

Still further, the achieve the above-mentioned object, according to a third aspect of the present invention, there is provided a hydraulic circuit including a pressure compensating valve wherein the pressure compensating valve is provided between a hydraulic pump and a directional control valve, the pressure compensating valve being arranged to be urged by the fluid pressure applied to its first pressure receiving portion to a position where the area of opening thereof is kept maximum, and also urged by the fluid pressure applied to its second pressure receiving portion to a position where the area of opening thereof is kept minimum, the first pressure receiving portion being connected with the outlet side of the directional control valve, the second pressure receiving portion being connected with the inlet side of the directional control valve, characterized in that the arrangement is made such that the fluid under pressure discharged by an exterior pressurized fluid supply source is supplied through the directional control valve held at its neutral position into the first pressure receiving portion of the pressure compensating valve.

Yet further, to achieve the above-mentioned object, according to a fourth aspect of the present invention, there is provided a hydraulic circuit including a pressure compensating valve wherein the pressure compensating valve is provided between a hydraulic pump and a directional control valve, the pressure compensating valve being arranged to be urged by the fluid pressure applied to its first pressure receiving portion to a position where the area of opening thereof is kept maximum, and also urged by the fluid pressure applied to its second pressure receiving portion to a position where the area of opening thereof is kept minimum, the first pressure receiving portion being connected with the outlet side of the directional control valve, the second pressure receiving portion being connected with the inlet side of the directional control valve, characterized in that the arrangement is made such that .the fluid under pressure discharged by an exterior pressurized fluid supply source is supplied through the directional control valve held at a pressurized fluid supply position into the first pressure receiving portion of the pressure compensating valve.

Further, to achieve the above-mentioned object, according to a fifth aspect of the present invention, there is provided a hydraulic circuit including a pressure compensating valve wherein the pressure compensating valve is provided between a hydraulic pump and a directional control valve, the pressure compensating valve being arranged to be urged by the fluid pressure applied to its first pressure receiving portion to a position where the area of opening thereof is kept maximum, and also urged by the fluid pressure applied to its second pressure receiving portion to a position where the area of opening thereof is kept minimum, the first pressure receiving portion being connected with the outlet side of the directional control valve, the second pressure receiving portion being connected with the inlet side of the directional control valve, characterized in that the arrangement is made such that the fluid under pressure on the outlet side of a pilot fluid pressure change-over valve adapted to change the directional control valve over to a pressurized fluid supply position is supplied into the first pressure receiving portion of the pressure conpensating valve.

According to the above-mentioned first aspect, when the directional control valve is located at its neutral position the pressure compensating valve is located at the position where the area of opening thereof is kept minimum, and therefore when the directional control valve is located at the pressurized fluid supply position, there is no delay in operation of the pressure compensating valve due to the time required for the inflow of fluid in an amount corresponding to the stroke volume thereof, thereby improving the response of the pressure compensating valve, and hence the response of the hydraulic circuit.

Further, according to the above-mentioned second aspect, when the directional control valve is changed over to the pressurized fluid supply position the pressure compensating valve is pushed immediately to the position where the area of opening thereof is kept maximum, and therefore there is no delay in operation of the pressure compensating valve due to the time required for the inflow of fluid in an amount corresponding to the stroke volume thereof, thereby improving the response of the pressure compensating valve, and hence the response of the hydraulic circuit.

Still further, according to the above-mentioned third aspect, when the directional control valve is located at its neutral position the fluid under pressure discharged by the exterior pressurized fluid supply source is supplied into the first pressure receiving portion of the pressure compensating valve to thereby hold the latter at the position where the area of opening thereof is kept maximum, and therefore when the directional control valve is located at the pressurized fluid supply position there is no delay in operation of the pressure compensating valve due to the time required for the inflow of fluid in an amount corresponding to the stroke volume thereof, that is to say, the pressure compensating valve can be rendered operative immediately, thereby improving the response of the hydrulic circuit.

Yet further, according to the above-mentioned fourth and fifth aspects, when the directional control valve is changed over to the pressurized fluid supply position the fluid under pressure is supplied into the first pressure receiving portion of the pressure compensating valve so that the latter is located immediately at the position where the area of opening thereof is kept maximum without causing any time delay in operation due to the time required for the inflow of fluid in an amount corresponding to the stroke volume thereof.

The above-mentioned and other objects, aspects and advantages of the present invention will become apparent to those skilled in the art by making reference to those skilled in the art by making reference to the following detailed description and the accompanying drawings in which preferred embodiments incorporating the principles of the present invention are shown by way of example only.

DETAILED DESCRIPTION OF PREFERRED EMBODIMENTS

Figure 1:
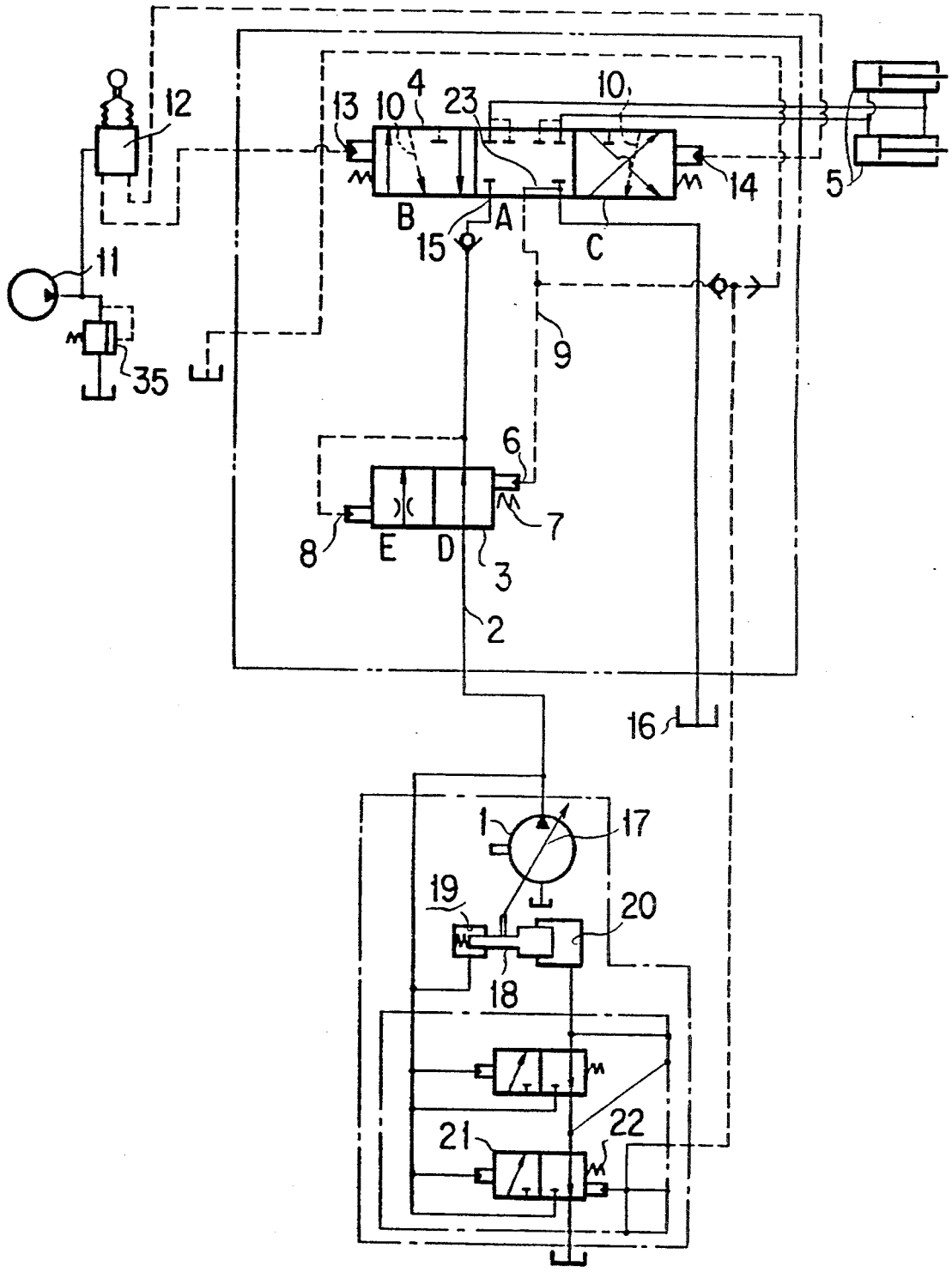
FIG. 1 is a hydraulic circuit diagram including a prior art pressure compensating valve.
Figure 2:
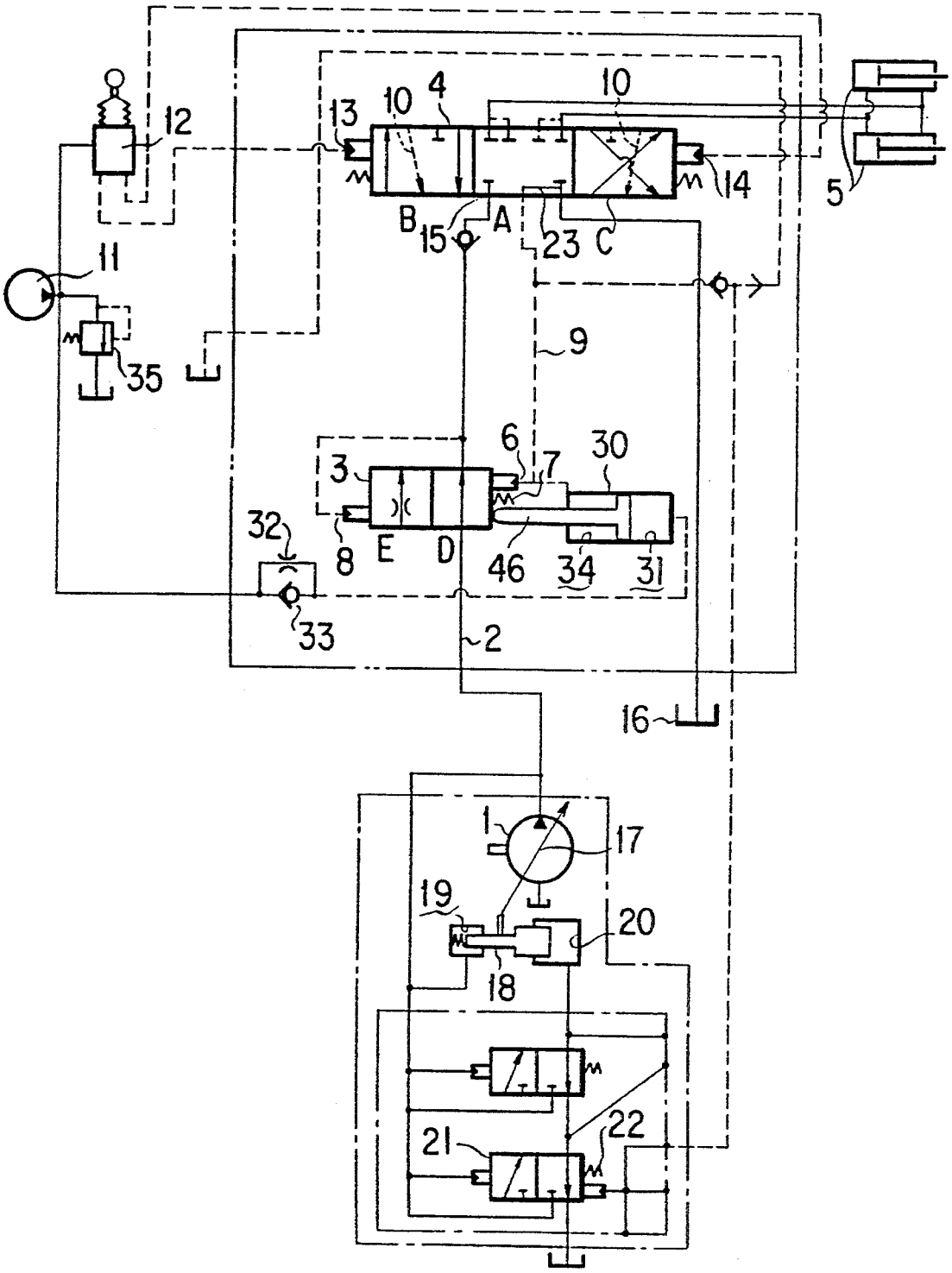
FIG. 2 is a hydraulic circuit diagram showing a first embodiment of the present invention.

FIG. 2 is a hydraulic circuit diagram showing one embodiment of the present invention. Its component parts same as those of the prior art hydraulic circuit shown in FIG. 1 are indicated by the same reference numerals and characters, and the detailed description of them are omitted herein.

A hydraulic cylinder means 30 is provided which has a piston 46 adapted to push against a pressure compensating valve 3 to its position D where the area of opening thereof is kept maximum, and a piston elongating chamber 31 is connected through a restrictor 32 and a check valve 33 with a discharge conduit of an auxiliary hydraulic pump 11 serving as an exterior fluid pressure supply source, whilst a piston retracting chamber 34 is connected with a load pressure circuit 9.

The pressure of pressurized fluid discharged by the above-mentioned hydraulic pump 11 is regulated by a relief valve 35. The magnitude of the thrust afforded by the piston 46 of the hydraulic cyclinder means 30 is equal to the discharge pressure multiplied by the area of the piston elongating chamber 31 which is subjected to the fluid pressure. This piston thrust is set at a value larger than a thrust required to urge the pressure compensating valve 3 to its position E where the area of opening thereof is kept minimum (which equals to the discharge pressure of the hydraulic pump 1 multiplied by the area of a second pressure receiving portion 8).

Figure 3:
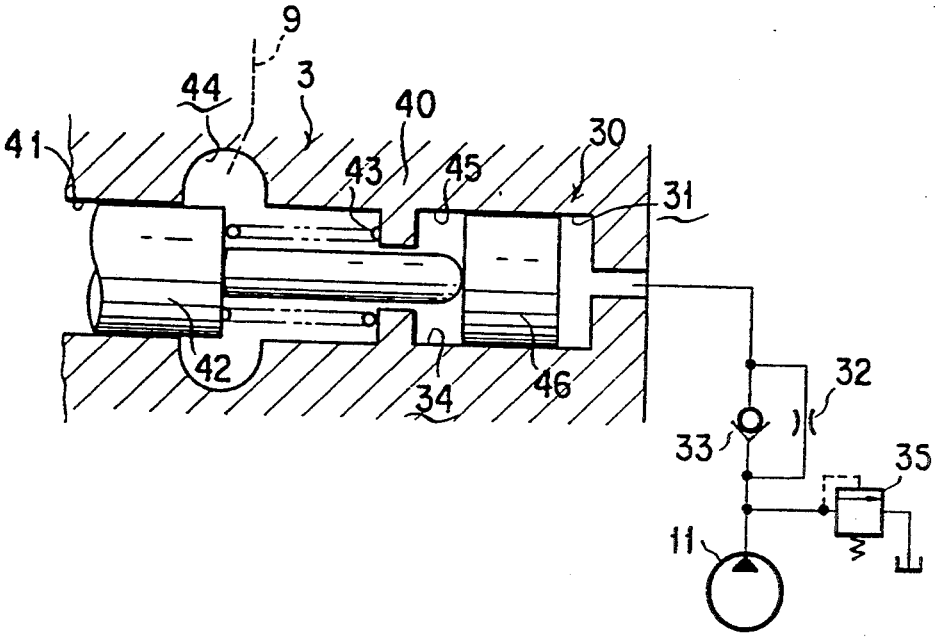
FIG. 3 is a sectional view showing one embodiment of combination of a pressure compensating valve and a hydraulic cylinder unit.

FIG. 3 shows one embodiment of combination of the pressure compensating valve 3 and the hydraulic cylinder means 30. The pressure compensating valve 3 comprises a spool 42 slidably inserted in a spool hole 41 formed within a valve body 40, and a spring 43 mounted in a chamber 44 urging the spool 42 to the position D where the area of opening thereof is kept maximum, the spring chamber 44 serving as a first pressure receiving portion 6.

The above-mentioned valve body 40 has also a cylinder hole 45 formed therein coaxially with the spool hole 41 and in which the piston 46 is slidably inserted, thus forming the hydraulic cylinder means 30 having the piston elongating chamber 31 and the piston retracting chamber 32. One end of the spool 42 is held in contact with the piston 46, and also the piston retracting chamber 34 is allowed to communicate with the spring chamber 44 (that is, the first pressure receiving portion 6).

In the next place, operation of the hydraulic circuit is described.

When a directional control valve 4 is located at its neutral position A, the load pressure circuit 9 is connected with a fluid tank 16 so as to keep the load pressure in the circuit 9 at zero as mentioned hereinabove, so that the pressure compensating valve 3 is urged to and held at the position D, where the area of opening thereof is kept maximum by the thrust of the piston 46 developed by the fluid under pressure supplied into the piston elongating chamber 31 of the hydraulic cylinder means 30.

When the directional control valve 4 is changed from its neutral position over either to a first pressurized fluid supply position B or to a second pressurized supply position C, the load pressure in the load pressure circuit 9 is raised successively so that when a thrust force acting on the piston 46 of the hydraulic cylinder means 30 in such a direction as to retract the piston 46 becomes more than the above-mentioned thrust force acting on the piston 46 due to the fluid pressure applied to the piston elongating chamber 31 the piston 46 commences to retract or move away from the pressure compensating valve 3. As a result, the pressure compensating valve 3 will have an area of opening which depends on the pressure differential between the inlet and outlet pressures of the directional control valve 4.

The time required for the rise in the pressure within the first pressure receiving portion 6 at that time is influenced by the stroke volume of the hydraulic cylinder means 30, however, since the pressurized fluid within the piston elongating chamber 31 flows out through the restrictor 32, the movement of the piston 46 is very slow, and as a result, the above-mentioned influence by the stroke volume of the hydraulic cylinder means 30 is limited to a level which does not cause any problem in practical application.

Figure 4:
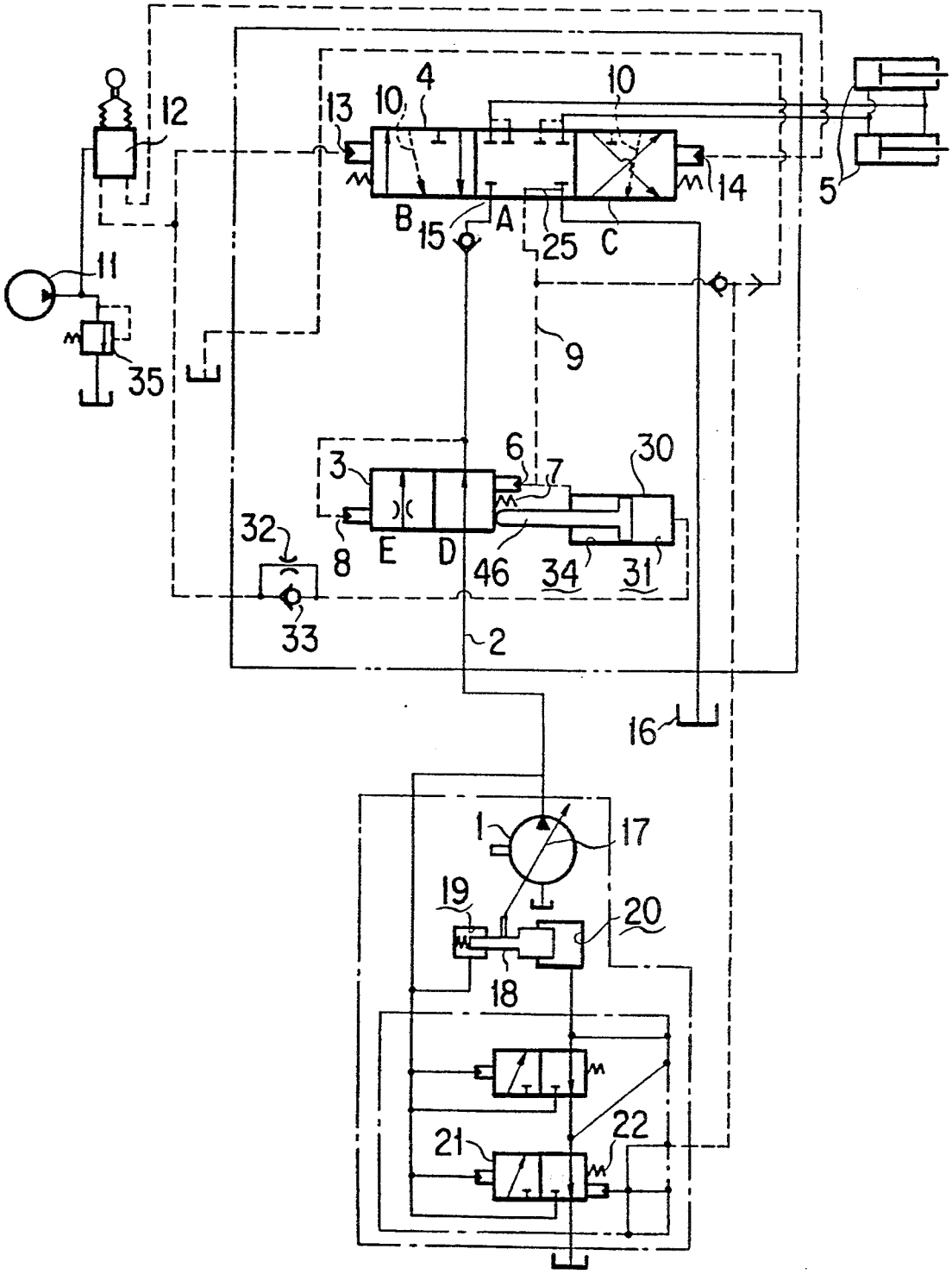
FIG. 4 is a hydraulic circuit diagram showing a second embodiment of the present invention.

FIG. 4 shows a second embodiment of the present invention in which a piston elongating chamber 31 of a hydraulic cylinder means 30 is connected with a first pressure receiving portion 13 of a directional control valve 4, the arrangement being made such that when the directional control valve 4 is changed from its neutral position over to its first pressurized fluid supply position B the piston 46 in the hydraulic cylinder means 30 is extended.

Figure 5:
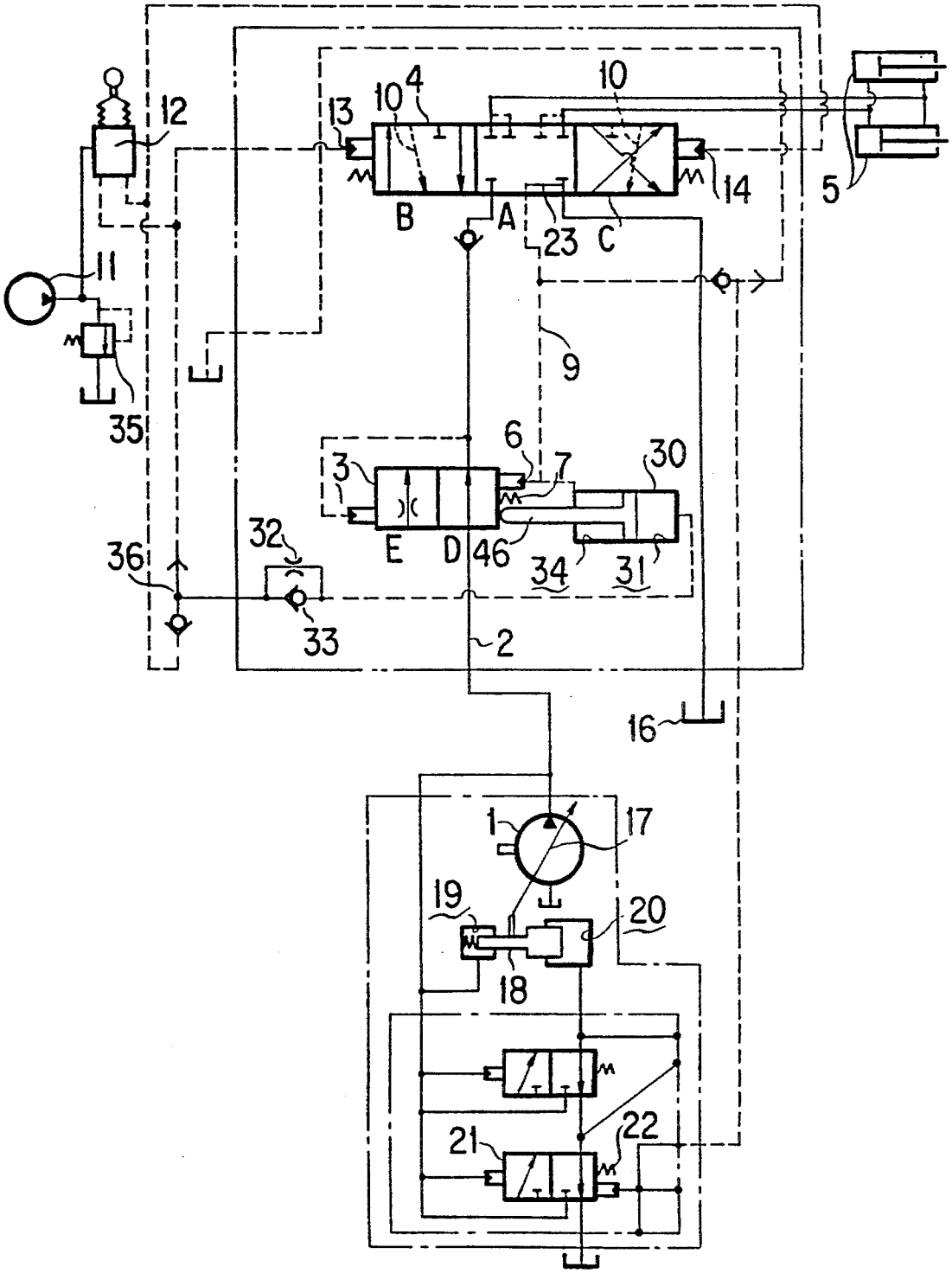
FIG. 5 is a hydraulic circuit diagram showing a third embodiment of the present invention.

FIG. 5 shows a third embodiment of the present invention in which a piston elongating chamber 31 of a hydraulic cylinder menas 30 is connected through a shuttle valve 36 with a first pressure receiving portion 13 and a second pressure receiving portion 14 on high pressure sides of a directional control valve 4, the arrangement being made such that when the directional control valve 4 is changed from its neutral position A over either to the first pressurized fluid supply position B or to the second pressurized fluid supply position C the piston 46 in the hydraulic cylinder means 30 is extended.

Figure 6:
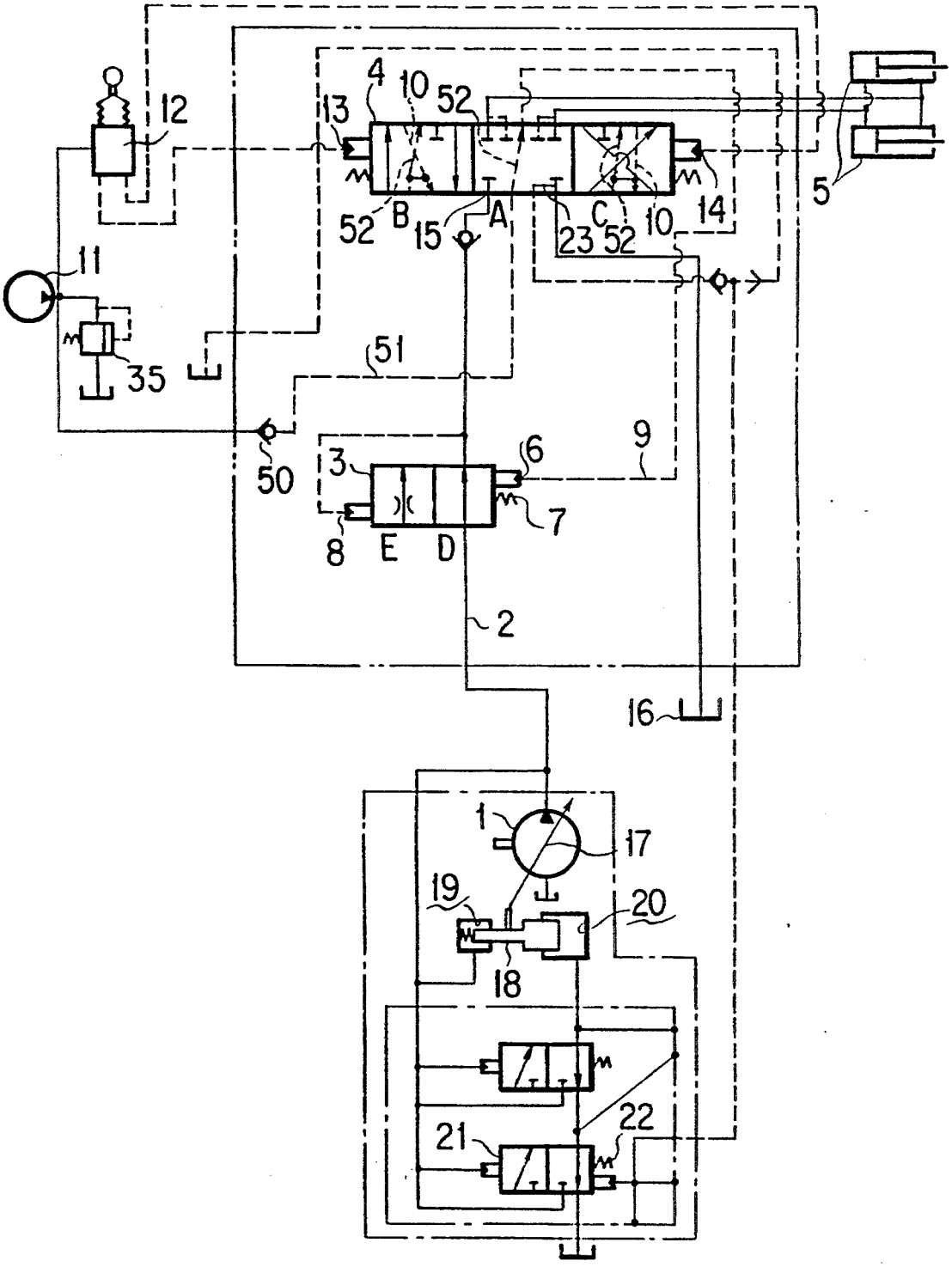
FIG. 6 is a hydraulic circuit diagram showing a fourth embodiment of the present invention.

FIG. 6 shows a fourth embodiment of the present invention in which a directional control valve 4 has a passage 52 formed in a neutral position A and which connectes a circuit 51 that is connected through a check valve 50 with a discharge conduit of an auxiliary hydraulic pump 11 with a load pressure circuit 9, the arrangement being made such that when the directional control valve 4 is located at its neutral position A the pressurized fluid discharged by the auxiliary hydraulic pump 11 is supplied through the passage 52 and the load pressure circuit 9 into a first pressure receiving portion 6 of a pressure compensating valve 3 so that the latter is held at its position D where the area of opening thereof is kept maximum.

Thus, when the directional control valve 4 is switched from its neutral position A over either to the first pressurized fluid supply position B or to the second pressurized fluid supply position C a load pressure detection passage 10 is allowed to communicate with an internal passage 23 and the passage 52 so that the discharge pressure of the auxiliary hydraulic pump 11 and the load pressure are supplied into the first pressure receiving portion 6 of the pressure compensating valve 3. Consequently, when the load pressure becomes higher than the discharge pressure of the auxiliary hydraulic pump 11 the hydraulic circuit according to the fourth embodiment is rendered operative in the same manner as the prior art hydraulic circuit.

In this arrangement, there is no need for provision of the hydraulic cylinder means.

Figure 7:
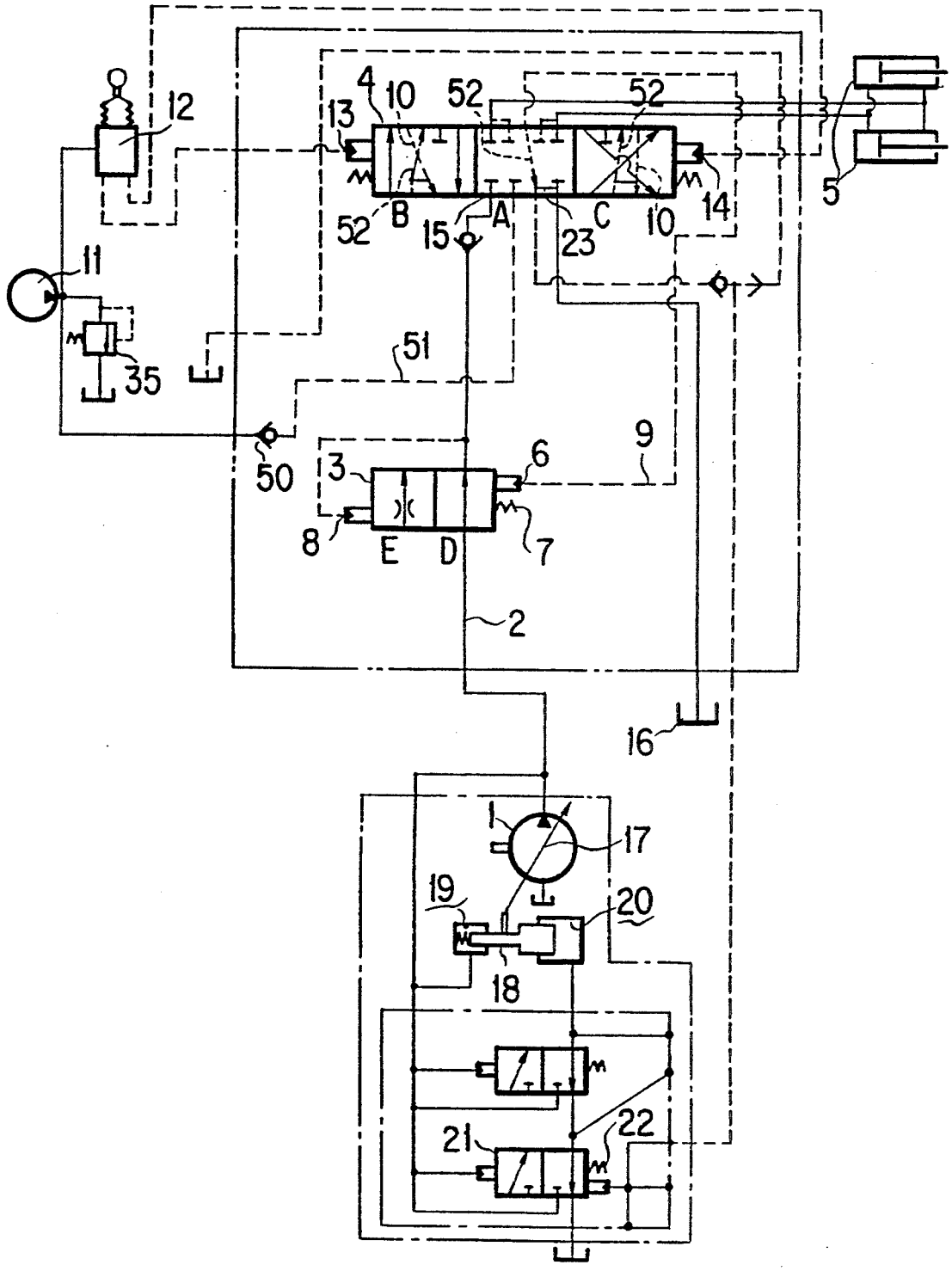
FIG. 7 is a hydraulic circuit diagram showing a fifth embodiment of the present invention.

FIG. 7 shows a fifth embodiment of the present invention in which when the directional control valve 4 is located at its neutral position A the aforementioned passage 52 is connected with the interior passage 23, and is disconnected from the circuit 51, whilst when the directional control valve 4 is held either at the first pressurized fluid supply position B or at the second pressurized fluid supply position C, the passage 52 is allowed to communicate with the circuit 51. When the directional control valve 4 is changed from its neutral position A over either to the first pressurized fluid supply position B or to the second pressurized fluid supply position C the pressurized fluid discharged by the auxiliary hydraulic pump 11 is supplied into the first pressure receiving portion 6 of the pressure compensating valve 3, thereby rendering it possible to prevent the delay in response due to the time required for the inflow of fluid in an amount corresponding to the stroke volume thereof.

Figure 8:
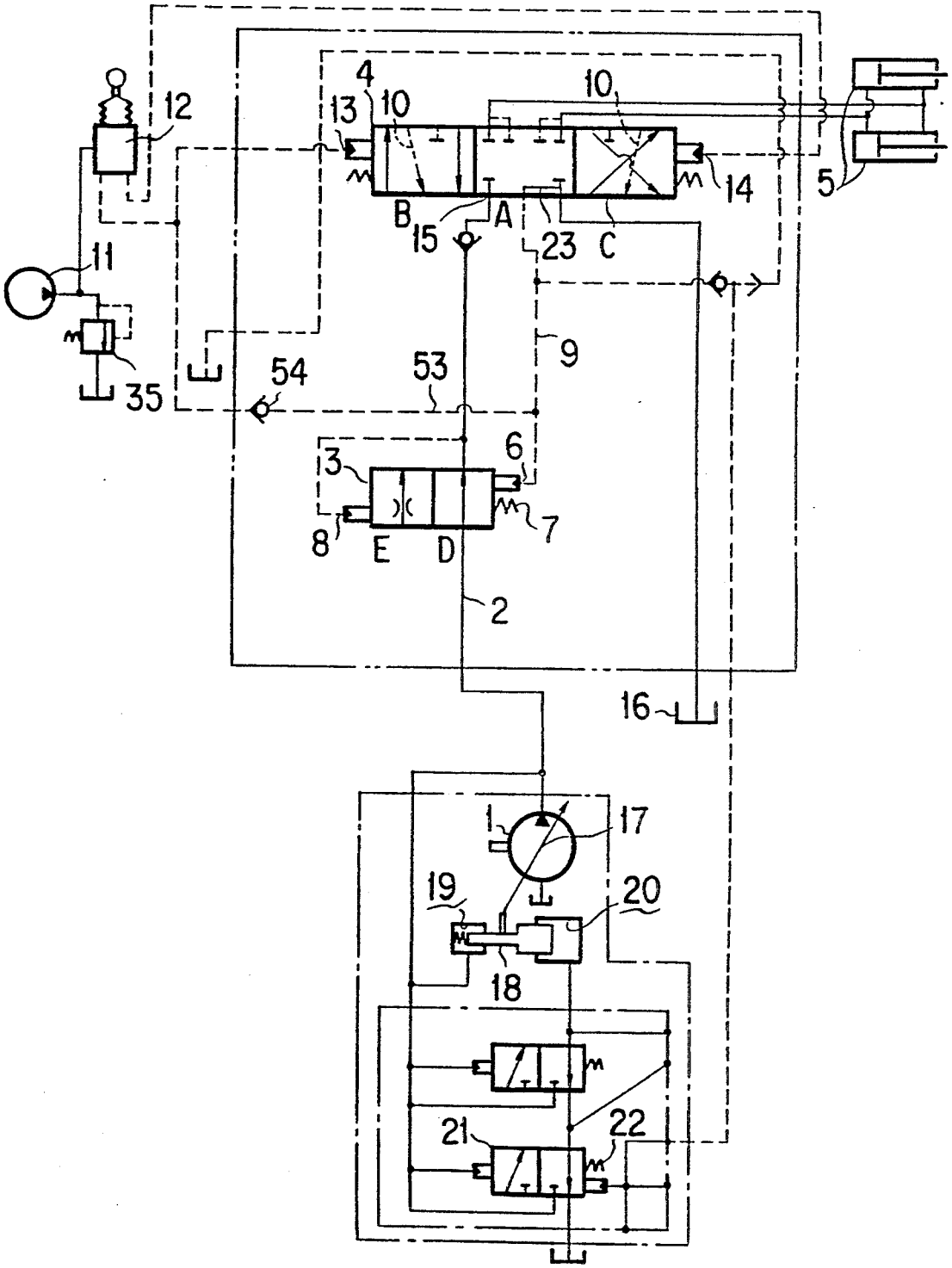
FIG. 8 is a hydraulic circuit diagram showing a sixth embodiment of the present invention.

FIG. 8 shows a sixth embodiment of the present invention in which a circuit 53 connected with a load pressure circuit 9 is connected through a check valve 54 with a first pressure receiving portion 13 of a directional control valve 4, the arrangement being made such that when the directional control valve 4 is changed over to the first pressurized fluid supply position B a part of the pilot pressurized fluid is supplied into a first pressure receiving portion 6 of a pressure compensating valve 3.

Figure 9:
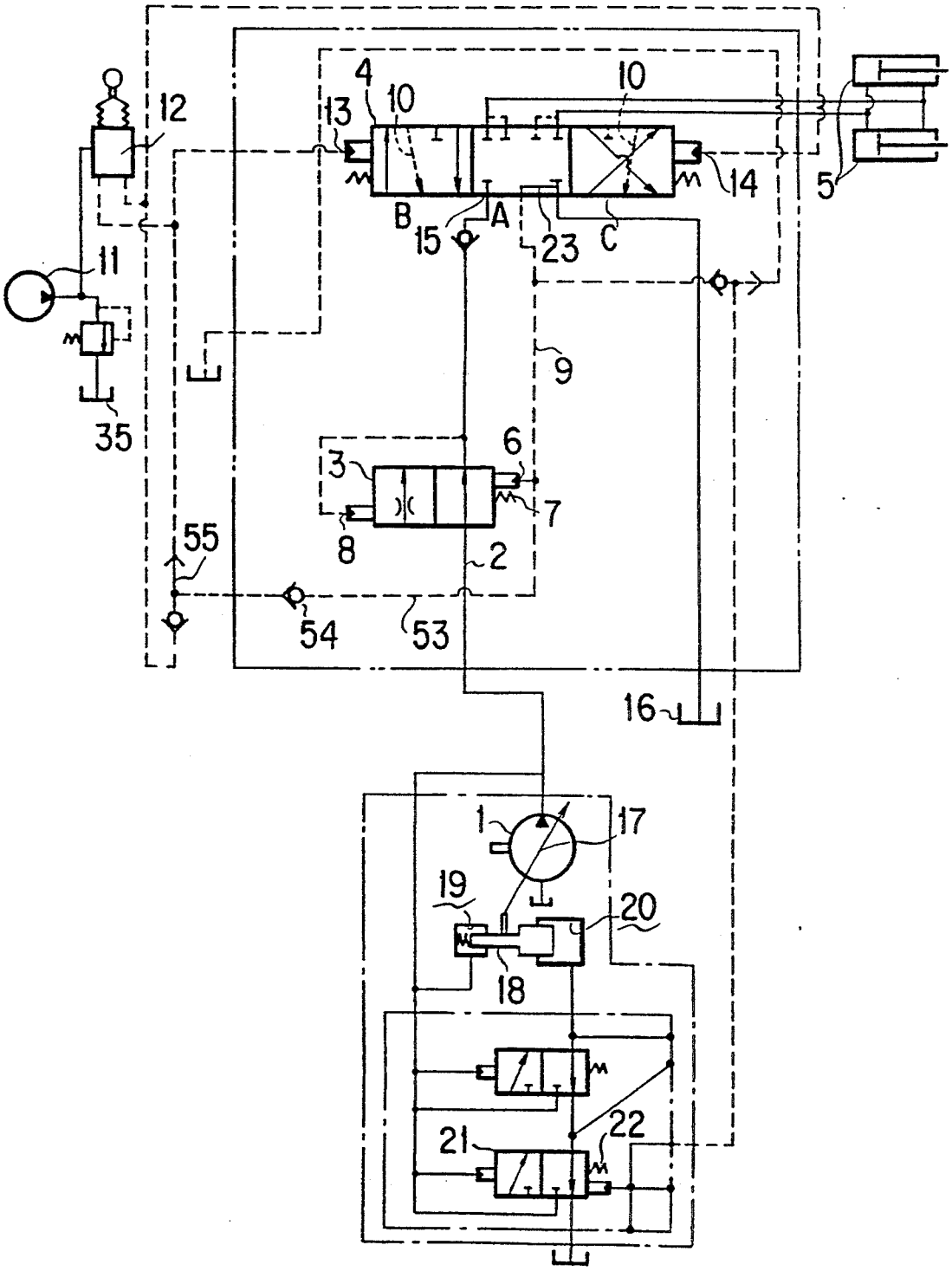
FIG. 9 is a hydraulic circuit diagram showing a seventh embodiment of the present invention.

FIG. 9 shows a seventh embodiment of the present invention in which a circuit 53 connected with a load pressure circuit 9 is connected through a check pressure circuit 9 is connected through a check valve 53 and a shuttle valve 54 with a first pressurized fluid supply position 13 and a second pressurized fluid supply position 14 of a directional control valve 4, the arrangement being made such that when the directional control valve 4 is held either at the first pressurized fluid supply position B or at the second pressurized fluid supply position C the pilot pressurized fluid is supplied into a first pressure receiving portion 6 of a pressure compensating valve 3.

Figure 10:
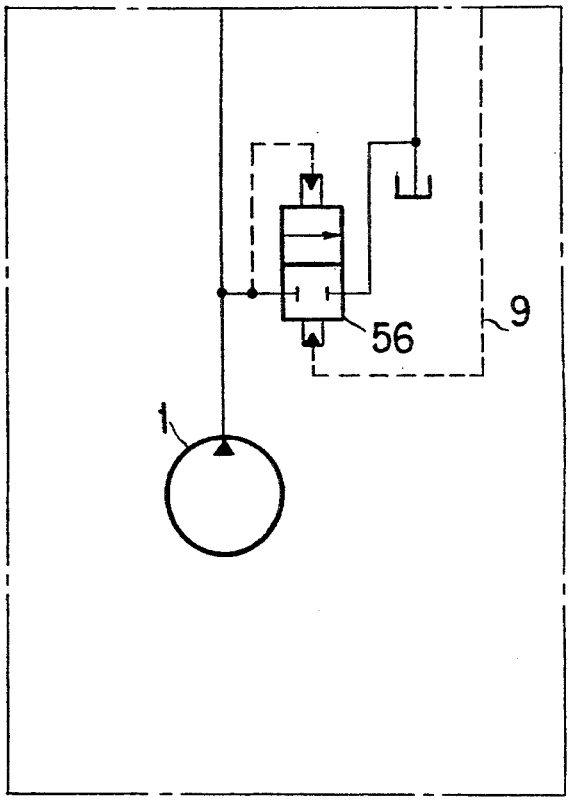
FIG. 10 is a hydraulic circuit diagram in which a fixed displacement type hydraulic pump is used.

While the foregoing embodiments of the present invention have been described in case the hydraulic pump 1 is of a variable displacement type, in case a fixed displacement type hydraulic pump 1 is used it is only necessary to provide an unloading valve 56 as shown in FIG. 10.

We claim:

1. A hydraulic circuit comprising:

a pressure compensating valve provided between a hydraulic pump and a directional control valve having an inlet side, an outlet side and a neutral position, the pressure compensating valve being responsive to the fluid pressure applied to a first pressure receiving portion for increasing the open area toward a maximum area, and responsive to the fluid pressure applied to a second pressure receiving portion for decreasing the open area toward a minimum area, the first pressure receiving portion being connected with the outlet side of the directional control valve, the second pressure receiving portion being connected to the inlet side of the directional control valve, an external pressurized fluid supply source, and means for applying the fluid under pressure discharged by said external pressurized fluid source through the directional control valve held at said neutral position into the first pressure receiving portion.

2. A hydraulic circuit comprising:

a hydraulic pump;

a direction control valve having a neutral position;

a pressure compensation valve interposed between said hydraulic pump and said direction control valve, and having a first pressure receiving portion receiving a hydraulic force for operating said pressure compensation valve toward a maximum open area position and a second pressure receiving portion receiving a hydraulic force for operating said pressure compensation valve toward a minimum open area position, said first pressure receiving portion being connected to an outlet side of said direction control valve and said second pressure receiving portion being connected to an inlet side of said direction control valve; and means active while said direction control valve is placed in said neutral position, for exerting a force to said pressure compensation valve for shifting toward said maximum open area;

means associated with said pressure compensation valve for compensating a stroke volume in response to operation of said direction control valve.

3. A hydraulic circuit comprising:

a hydraulic pump;

a direction control valve having a neutral position;

a pressure compensation valve interposed between said hydraulic pump and said direction control valve, and having a first pressure receiving portion receiving a hydraulic force for operating said pressure compensation valve toward a maximum open area position and a second pressure receiving portion receiving a hydraulic force for operating said pressure compensation valve toward a minimum open area position, said first pressure receiving portion being connected to an outlet side of said direction control valve and said second pressure receiving portion being connected to an inlet side of said direction control valve; and means active while said direction control valve is placed in said neutral position, for exerting a force to said pressure compensation valve for shifting toward said maximum open area;

means associated with said pressure compensation valve and responsive to operation of said direction control valve in the direction for increasing the hydraulic force acting on said second pressure receiving portion, for compensating a stroke volume for quick response of taking up fluid pressure acting on said second pressure receiving portion.

4. A hydraulic circuit comprising:

a first hydraulic pressure source;

a direction control valve for supplying a hydraulic pressure to a hydraulic load;

a pressure compensation valve interposed between said hydraulic pump and said direction control valve, and having a first pressure receiving portion receiving a hydraulic force for operating said pressure compensation valve toward a maximum open area position and a second pressure receiving portion receiving a hydraulic force for operating said pressure compensation valve toward a minimum open area position, said first pressure receiving portion being connected to an outlet side of said direction control valve and said second pressure receiving portion being connected to an inlet side of said direction control valve; and hydraulic circuit means including a second hydraulic pressure source and active during transition of a load pressure on said hydraulic load for compensating lag in increasing of the pressure in said first pressure receiving portion by supplying the pressurized fluid to said first pressure receiving portion during the initial stage of said transition;

said hydraulic circuit means forms a closed circuit terminating at said first pressure receiving portion, in which is provided a one-way check valve interposed between said second hydraulic pressure source and said first pressure receiving portion for compensating the load pressure fed back to said pressure compensation valve.

5. A hydraulic circuit as set forth in claim 4, which further comprises a pressure relief means for relieving excessive pressure supplied from said second hydraulic pressure source to said closed circuit.

6. A hydraulic circuit as set forth in claim 4, wherein said closed circuit is established at the neutral position of said direction control valve.

* * * * *